US007838803B1

(12) United States Patent
Rosen

(10) Patent No.: US 7,838,803 B1
(45) Date of Patent: Nov. 23, 2010

(54) ELECTRIC BASEBOARD HEATER CONTROL

(76) Inventor: Howard Rosen, 1 Lyncroft Rd., Montreal (CA) H3X 3E3

( * ) Notice: Subject to any disclaimer, the term of this patent is extended or adjusted under 35 U.S.C. 154(b) by 479 days.

(21) Appl. No.: 11/852,036

(22) Filed: Sep. 7, 2007

(51) Int. Cl.
*H05B 1/02* (2006.01)

(52) U.S. Cl. ..... 219/497; 219/492; 236/1 C

(58) Field of Classification Search ..... 219/492, 219/497, 501, 505, 506, 483–486; 323/235, 323/319; 236/1 C, 46 R, 51
See application file for complete search history.

(56) References Cited

U.S. PATENT DOCUMENTS 4,010,412 A * 3/1977 Forman ..... 323/236
4,786,799 A * 11/1988 Welle et al. ..... 219/486
5,293,028 A * 3/1994 Payne ..... 219/486
5,908,571 A 6/1999 Scott
7,175,098 B2 2/2007 DeLuca

* cited by examiner

*Primary Examiner*—Mark H Paschall
(74) *Attorney, Agent, or Firm*—Marc E. Hankin; Kevin Schraven; Hankin Patent Law, APC

(57) ABSTRACT

In order to provide an electric heat system that is quieter than those of the prior art, a switching circuit is incorporated into the controls for the heating system which provides for the heating elements of the electric heater to be kept at a more constant temperature than those of the prior art. The switching circuit regulates the output power to the degree desired while not inducing sharp changes in temperature of the coils of the electric heater and thus reduces the degree of rapid expansion and contraction of the coils and the enclosure for the heater. This in turn reduces the amount of mechanical noise produced by the electric heater while also reducing wear and tear on the heating element, the heater enclosure and objects near to the heater.

14 Claims, 6 Drawing Sheets

| | 501 | 502 | 503 | 504 | 505 |
|---|---|---|---|---|---|
| | % Power Applied | Repeated Gate Pattern → "0" is gate OFF; "1" is gate ON | # Cycles ON | # Cycles OFF | Cycles ON / Total Cycles |
| 551 | 50% | 01 | 1 | 1 | 1/2 |
| 552 | 50% | 0011 | 2 | 2 | 2/4 |
| 553 | 50% | 000111 | 3 | 3 | 3/6 |
| 554 | 33.3% | 001 | 1 | 2 | 1/3 |
| 555 | 66.6% | 011 | 2 | 1 | 2/3 |

FIG. 5

601 602 603 604 605

| % Power Applied | Gate Pattern for 20 cycles* → "0" is gate OFF; "1" is gate ON | # Cycles ON | # Cycles OFF | Cycles ON / Total |
|---|---|---|---|---|
| 0% | 0000000000 0000000000 | 0 | 20 | 0/20 |
| 5% | 1000000000 0000000000 | 1 | 19 | 1/20 |
| 10% | 1000000000 1000000000 | 2 | 18 | 2/20 |
| 15% | 1000000100 0000100000 | 3 | 17 | 2/20 |
| 20% | 1000010000 1000010000 | 4 | 16 | 3/20 |
| 25% | 1000100010 0010001000 | 5 | 15 | 4/20 |
| 30% | 1001001000 1001001000 | 6 | 14 | 5/20 |
| 35% | 1001001001 0100100100 | 7 | 13 | 6/20 |
| 40% | 1010010010 1010010010 | 8 | 12 | 7/20 |
| 45% | 1010101001 1010101010 | 9 | 11 | 8/20 |
| 50% | 0101010101 0101010101 | 10 | 10 | 9/20 |
| 55% | 0101010101 1010101011 | 11 | 9 | 10/20 |
| 60% | 1101011010 1101011010 | 12 | 8 | 11/20 |
| 65% | 1101011010 1101101110 | 13 | 7 | 12/20 |
| 70% | 1101101110 1101101110 | 14 | 6 | 13/20 |
| 75% | 0111101110 1110111011 | 15 | 5 | 14/20 |
| 80% | 1101111011 1101111011 | 16 | 4 | 15/20 |
| 85% | 1101111110 1111110111 | 17 | 3 | 16/20 |
| 90% | 0111111111 0111111111 | 18 | 2 | 17/20 |
| 95% | 0111111111 1111111111 | 19 | 1 | 18/20 |
| 100% | 1111111111 1111111111 | 20 | 0 | 20/20 |

* Exemplary cycle is 1/60 of a second for 60 Hertz power source, 1/50 of a second for a 50 Hertz power source.

FIG. 6

ELECTRIC BASEBOARD HEATER CONTROL

FIELD OF THE INVENTION

This invention relates to the art of electric heating systems, baseboard heaters, thermostats, and electric radiant heating.

BACKGROUND OF THE INVENTION

Electric heaters often make noises as the thermostat controlling a heater cycles the heater on and off. This noise occurs because of the expansion and contraction of the components of the heater, in particular the enclosure for the heater, the heating coil and the brackets for holding the heating coil. The noise can be quite annoying and disruptive, for example when the heater is in a room where a person is trying to sleep. The expansion and contraction of the heater and objects near the heater can cause wear to the heater itself and to nearby objects. The expansion and contraction can be especially rapid and more likely to cause noise when the heater is mounted on an exterior wall of a building and the outside air is cold.

OBJECTS OF THE INVENTION

It is a primary object of this invention to provide a system to reduce the mechanical noise as typically made by electric heaters due to rapid expansion and contraction of the components of an electric heater as the heater is turned on and off.

It is a further broad object to provide an electric heater that produces a steady and therefore more comfortable source of heat.

It is another broad object of the invention to minimize the generation of radio frequency electrical noise due to switching on and off the heating elements or controlling the amount of electrical power applied to the heating elements of an electric heater.

BRIEF SUMMARY OF THE INVENTION

Briefly, these and other objects of the invention are achieved in a preferred embodiment of the present invention which carries out the method and apparatus of the present invention. According to the teachings of the present invention, the preferred embodiment incorporates enhancements over the state of the art to a thermostat controlling the electric heater. The enhancements incorporate apparatus or method for controlling the electric heater such that the power applied to the electric heater is adjusted continuously to provide just the required heat from the heater, rather than cycling the heater fully on and off over periods of time long enough to cause expansion and contraction of the various parts of the heater which in turn would potentially induce mechanical noise. That is, the power is controlled in a manner which keeps the temperature of the heating elements fairly constant rather than changing rapidly, which minimizes the gradients of temperature and resultant contraction and expansion of components of the electric heater.

DESCRIPTION OF THE DRAWING

The subject matter of the invention is particularly pointed out and distinctly claimed in the concluding portion of the specification. The invention, however, both as to organization and method of operation, may better be understood by reference to the following description taken in conjunction with the subjoined claims and the accompanying drawing of which:

FIG. 5 illustrates exemplary patterns for the gate input to a power gating triac type device which would result in application of several illustrative levels of average power; and FIG. 6 further illustrates more complex exemplary patterns for the gate input to a power gating triac type device for producing selected levels of average power.

DESCRIPTION OF THE PREFERRED EMBODIMENT(S)

Figure 1:
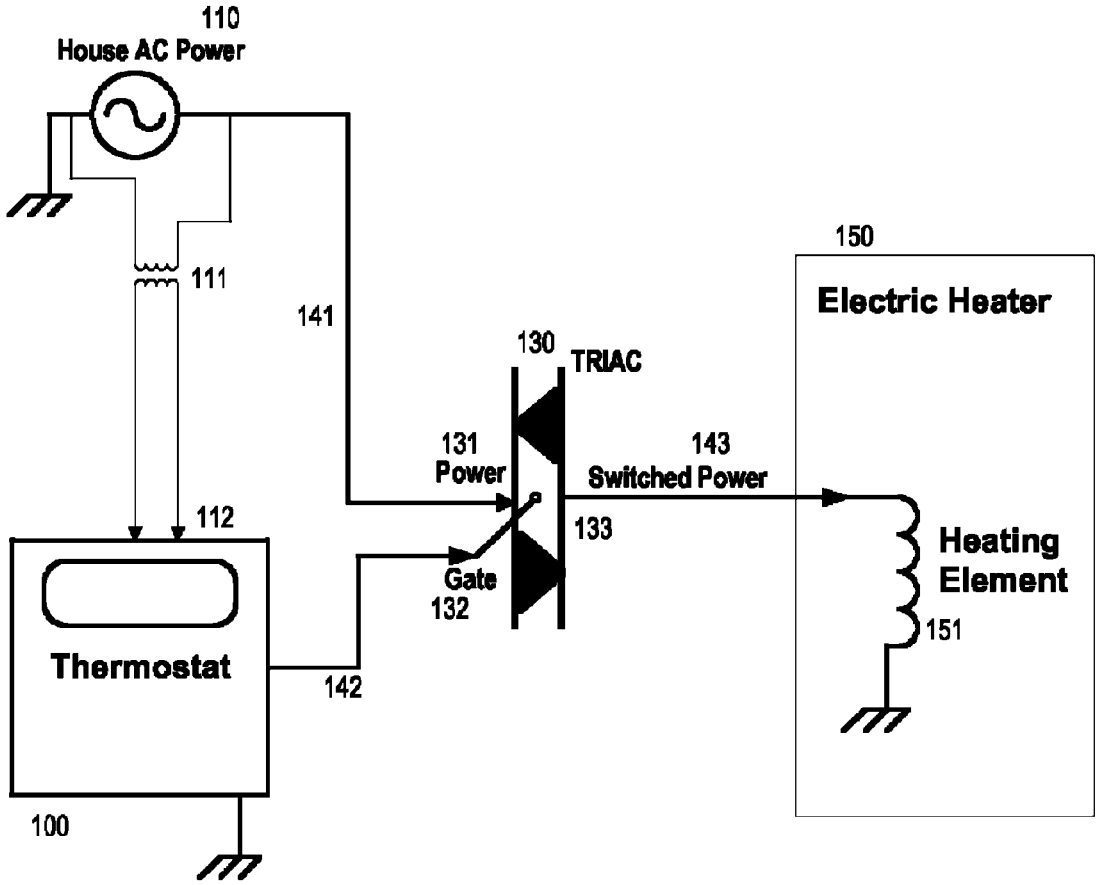
FIG. 1 is a diagram showing an electric heater powered from house power passing through a triac circuit controlled by a thermostat.

It is common in the prior art for an electric heater to be controlled utilizing an apparatus or method in which a thermostat controls the application of house power to heating elements of the electric heater and the thermostat causes switching of the heating elements on or off depending on the need for heat. There is typically some hysteresis in the switching such that the house power is applied for on and off periods of at least several seconds, typically at least 15 seconds or more.

According to the present invention the preferred embodiment teaches enhancement to the thermostat and control mechanism for an electric heater. The enhancements provide for the heating coils to have an average power applied to them which is smoothed over a short period of time while meeting the overall requirements for heating. The power to the coils is smoothed such that as heating requirements vary, the need is met with slow changes in the average power applied to the heating coils of the heater and as a result the temperature of the heating elements also varies slowly. This reduces the degree of overall expansion and contraction of the heating elements when compared to common methods of the prior art.

Smoothing of the power and reduction of expansion and contraction of the heating elements and the enclosure of the heater itself potentially results in a reduction in noise from the heater in comparison to controls of the prior art. The smoothing of the power and the resultant heat from the heater also significantly reduces the sharpness of the temperature change applied by the heater to nearby objects which reduces damage to those objects due to expansion and contraction caused by sharp heat gradients.

The preferred embodiment of the present invention further teaches that the smoothing of power applied to the heating elements of the electric heater can be accomplished by controlling the distribution of power to the heating elements with a triac or other semiconductor device with similar function that can switch the alternating current (a.c.) power to the heating elements fully on or fully off under control of a gate connection. The preferred embodiment teaches that switching of power applied to the elements from on to off or off to on is controlled such that the switching occurs at or near the zero crossing of the alternating current (a.c.) house power supply to the heater. This a.c. supply current is typically supplied by a 110 to 120 volt, or 220 to 240 volt, 50 Hertz or 60 Hertz connection to the house or building's main electrical power distribution system. Switching the power to the heating elements at or near the zero crossing of the supply power reduces radio frequency noise generated by the switching.

The preferred embodiment of the present invention further teaches that the smoothing of power applied to the heating elements be achieved by switching the power on and off at a significantly higher frequency than typically utilized in the state of the art.

In the prior art, a typical minimum time for cycling from on to off or off to on is typically in the range of five to fifteen or more seconds. For exemplary purposes the following discussion will describe the prior art using an exemplary number of 15 seconds for the period of switching.

This means that when a need for more heat is sensed by a thermostat, full power is applied to the heating elements for at least 15 seconds before the resultant rise in temperature of the air near the thermostat is close enough to the desired temperature and the power to the heater elements is switched off. At the beginning of the "on" period when the heating elements have just been turned on, the temperature of the heating elements rises quickly. Once the desired temperature is reached, the heating elements are turned off and quickly cool. The room then begins to cool. When the thermostat senses that the room has cooled below a chosen set point (a set temperature) the power to the heating elements is again turned fully on. The repeated switching from application of full power followed by application of zero power for periods of at least several seconds results in mechanical expansion and contraction of the heater elements, the heater enclosure, and objects near to the heater. This mechanical expansion and contraction creates potential for generation of mechanical noise due to the shifting or movement of the components of the heater or any nearby objects.

The preferred embodiment of the present invention further teaches that the power to the heater is better controlled for purposes of the invention by providing for switching on or off the heating elements at the beginning or end of specific cycles of the a.c. (alternating current) supply power.

The preferred embodiment of the present invention further teaches that the overall effective power applied over a longer period of time be adjusted by controlling the number of on and off cycles of supply power applied to the heating elements. It is further taught that the switching from on to off or off to on be done at a high enough frequency such that the number of on cycles and off cycles are distributed evenly over time. For example, it would be preferable that if 50% power were desired, to achieve this by switching power on for one cycle and off for one cycle and to repeat that, rather than switching power on for five seconds, and off for five seconds and repeating that. The higher frequency of control switching (reduced period of control switching) reduces the sharp temperature gradients in the heating elements.

It is noted that achieving the very highest frequencies of switching, that is for example one cycle on and one cycle off for 50% power, is not necessary to achieve the desired smoothing of the power. It would be acceptable for example to repeat a pattern of two cycles on followed by two cycles off, or ten cycles on followed by ten cycles off. But at some point a longer time period for switching on to off or off to on will begin to cause expansion and contraction of the heating elements which is of enough significance to potentially produce mechanical noise. Determination of a precise period for a pattern at which generation of unwanted mechanical noise would be a possibility would depend upon the specific heater design, the placement of the heater in a room and other factors such as outside temperature and amount of air circulation. But a precise choice is not necessary because switching based upon a reasonably small number of cycles of house power which is typically 50 or 60 Hertz easily reduces the switching period below the period of time that would cause mechanical noise from the heater.

In the preferred embodiment of the invention the switching is done with the shortest period of switching, that being a single full cycle of the a.c. house supply power. At 50 Hertz this would be 1/50th of a second, and at 60 Hertz the minimum switching cycle would be 1/60th of a second. The pattern chosen for application of the desired percentage of power should be the shortest pattern that will produce the percentage of maximum (full) power that is desired.

Percentage of Power

In conjunction with the method or apparatus briefly herein just described for smoothly applying a percentage of power to the heating elements of an electric heater, it is necessary to determine what percentage of power should be applied in order to meet the heating requirements of the room. In one example solution from the preferred embodiment the percentage of power required can be calculated by looking at the percentage of power now being applied and increasing it by some small percentage whenever the temperature falls below the set point, or by decreasing it by some small percentage whenever the temperature rises above the set point.

As an example, one hundred and one possible settings from 0 percent (no power) to 100% power (full power) might be provided, and the apparatus or method for determining the percentage of power could increase or decrease the current percentage being applied by one percent every few seconds. This simple algorithm would mean that once an almost constant temperature is reached in the room, the percentage of power applied would be sampled every few seconds and would go up one percentage or down one percentage every few seconds. Once a state of fairly constant temperature is achieved, the method and apparatus might change the sample time of the thermostat to once every 30 seconds or so to further smooth the power and to account for the delay between when a change in power to the heating elements actually results in a change in temperature at the thermostat. With a thermostat on the opposite wall of the room from a heater, the delay from applying power to being able to notice the effect of the power at the thermostat could be many seconds or even minutes. Adaptive algorithms dependent on the precise characteristics of the heater or room or other similar factors are easily devised by someone knowledgeable in the state of the art.

OVERALL DESCRIPTIONS OF ALTERNATIVE EMBODIMENTS

Alternative embodiments of the present invention will now be described in greater detail to further illustrate the invention.

In a typical heating system a thermostat is used to provide a signal when there is a need for heat. With a simple typical thermostat there is a simple signal signifying one of only two possible conditions, the need for heat or the need for no heat. The thermostat determines this by comparing the temperature of the air surrounding the thermostat with a temperature preset by the user of the heating system. With most typical thermostats of the prior art there is some hysteresis that keeps the signal for heat on or off for some number of seconds or even minutes before the signal changes from on to off or off to on. Typical thermostats also have some small range of temperature change that is required before a switch from on to off or off to on is effected, a typical range of temperature being one-half to three degrees Fahrenheit.

Power Control Considerations

According to the teachings of the present invention the preferred embodiment(s) includes an apparatus or method for controlling the electrical power applied to an electric heater. Further included in the preferred embodiment of the present invention is apparatus or method of controlling the power applied for short intervals such that the heater can be turned fully on or fully off for short periods of time, with that period of time in the preferred embodiment being based upon a number of full cycles of house or main power voltage.

The present invention then teaches that by making adjustable the short intervals of time that the heater is fully on or fully off allows an adjustable portion of maximum heat to be effected. For example, if for a short period of time full power was applied to the heater, and then for a second short interval of the same time no power was applied, the effective overall power applied over a longer time period would be 50 percent of maximum power. As a second example, if full power was applied for one tenth of a second and no power was applied for three-tenths of a second and this cycle was continuously repeated, then the average effective power applied over a long time period could be calculated as:

0.1 seconds/(0.1 seconds+0.3 seconds)=>0.25=>25%.

Included as a further enhancement to the present invention is the stipulation that the intervals of time for switching the heater fully on or fully off be based upon some number of cycles of the main a.c. (alternating current) electrical power supply, which might typically be 50 or 60 cycles per second. This provides for the intervals of time to be a specific number of alternating current cycles.

The present invention further teaches that the switching of power to the heating elements from on to off, or off to on, be scheduled or timed such that the switching occurs when the voltage applied to the heating elements is at or near to the zero voltage crossing of the alternating current supply. This greatly reduces the radio frequency noise generated by the switching compared to the noise which might be generated if a switch were to clamp the output voltage to zero when the input was not near to zero volts, or allow the output voltage to be unclamped and jump rapidly from zero to some higher voltage, and also reduces the power dissipation in the switching circuitry itself. The switching of the power should also be done such that only full or complete cycles of the voltage or current waveform are passed through the switch, in order to avoid inducing direct current components on the wiring of the circuit or the house power.

The preferred embodiment of the invention further teaches that the switching of power from fully on to fully off and fully off to fully on occur frequently enough to provide for slow changes in effective overall power to the heating elements, with the purpose of minimizing mechanical noise from expansion and contraction due to sharp gradients or rapid changes in temperature of the heating element(s). The overall goal is to apply just enough average power to the heating elements of the heater to keep the room at the desired temperature, and to slowly vary the power to the elements to meet the need for heat in the room as determined by the thermostat. An exemplary period chosen for the preferred embodiment is a period of ten cycles of the alternating current. This would be one-fifth of a second at 50 Hertz, or one-sixth of a second at 60 Hertz. The proportion of power applied would thus be adjustable five or six times per second. Depending on the mechanical characteristics of the heater, having a period of time significantly longer than a few seconds could begin to induce significant expansion and contraction inducing the possibility of resultant mechanical noise.

It is noted as further teaching of the present invention that choosing a short interval between turning power to the heating elements fully on or fully off does not limit the precision to which the effective power can be adjusted by proportioning the on and off times. That is, selecting a supply power alternating current cycle count of ten, for example, does not limit the number of levels of effective heat that can be applied to only ten. For example, if 75% power were required, this could be achieved by repeating two patterns of power application, the first applies power for seven cycles on and three cycles off, the second applies power for eight cycles on and two cycles off, so the average effective power after these two patterns would be (7/10+8/10)/2=>0.75=>75%.

It is a further teaching of the present invention that utilizing repeating patterns of full power on to full power off allows an increase in the precision to which average heat can be adjusted. Achieving integral percentages from one to one hundred percent could be achieved, for example, by distributing on and off times as evenly as possible across one hundred cycles of the supply power. Distributing the on and off times evenly distributes the power applied as evenly as possible across the chosen period of time.

DETAILED DESCRIPTION OF THE PREFERRED EMBODIMENT

The preferred embodiment will now be described in greater detail with reference to the figures of the drawing.

FIG. 1 illustrates a basic electric heater 150 powered from a main house a.c. power supply 110 with power to the electric heater controlled by a triac circuit 130. The triac circuit 130 acts as a switch or gate that allows power from the house a.c. power source to be applied or not applied to the electric heater. The house a.c. power 110 is connected through wiring 141 to the power input 131 of the triac circuit. A triac gating signal 142 connected to the gate input 132 of the triac circuitry selectively allows the house power to flow through the triac to the switched power output 133 of the triac circuitry. This switched power output 133 is connected through wiring 143 to heating elements 151 of the electric heater. The triac gate signal 132 thus controls the application of house power to the heating element(s) of the electric heater. As shown, a thermostat 100 with associated processing circuitry produces the triac gating signal 142 which is operatively connected to the triac circuitry's gate input 132 as the triac gating signal. The thermostat's processing circuitry can thus control the application of house power to the heating element(s) of the electric heater.

In another aspect of the preferred embodiment, the thermostat is also connected to the house power supply 110 through a transformer 111 with this connection 112 optionally supplying power to the thermostat and as later described and discussed in reference to FIG. 4 providing an a.c. signal representative of the house power a.c. waveform for the processing circuitry to anticipate the time of zero-crossing for the voltage or current of the house power a.c. waveform.

Figure 2:
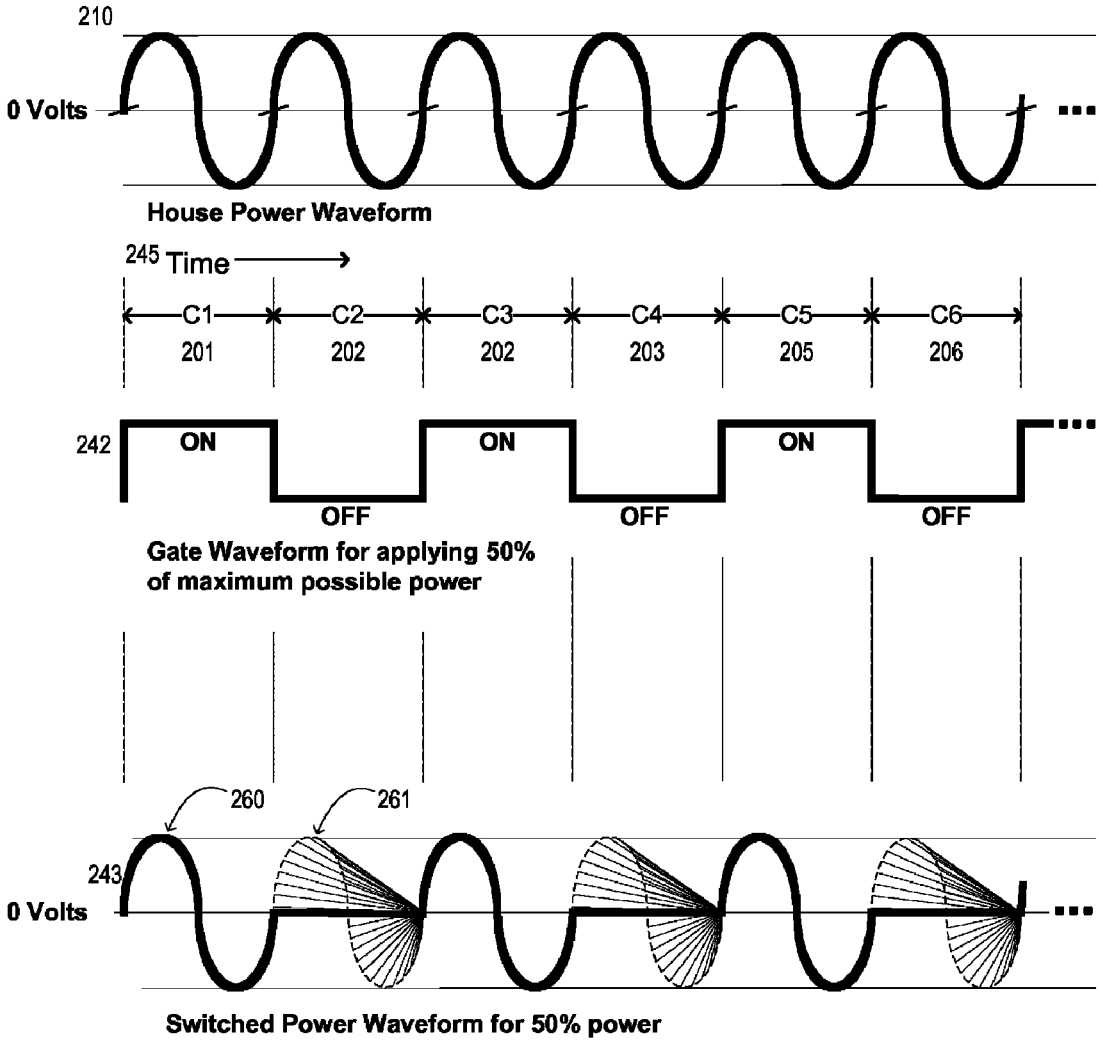
FIG. 2 shows waveforms for house power gated by a triac circuit applied to an electric heater such as to achieve production of approximately 50 percent of maximum possible heat.

FIG. 2 is an illustration showing exemplary waveforms of house power 210, a gating waveform 242 and resultant switched power waveform 243 when a production of 50% of maximum possible power, or resultant heat, is desired as determined by the processing circuitry of the thermostat. The house power waveform shown is a typical 240 volt a.c. power source. The house power waveform as shown is approximately sinusoidal with a typical frequency of 50 or 60 Hertz. The voltage waveform periodically crosses the zero axis at points as indicated by tic marks on the diagram of the house power waveform 210.

Six cycles C1 201, C2 202, C3 203, C4 204, C5 205, and C6 206 of the house power waveform are shown as denoted on the time line 245 below the house power waveform. In the preferred embodiment, a triac gate waveform 242 is applied by the thermostat processing circuitry to the gate input of the triac circuitry which switches the power through the triac ON and OFF, by clamping the output voltage to zero when the gate signal to the triac is OFF. These ON and OFF periods are marked with the gate being ON during cycles C1, C3 and C5 and OFF during cycles C2, C4, C6. The resultant switched power waveform 243 shows that the voltage output from the triac circuitry to the heating element(s) has one-half of the output cycles switched OFF, that is held at zero voltage, and thus one-half of the power is applied to the heating elements compared to what could be applied with no switching or gating of the source power.

In the diagram for the switched power waveform, the switched power is shown as a thick solid black line 260, and the power waveform that would have existed without gating is shown as a light dashed line 261. If this exemplary gate waveform is continued over a longer period, one-half of the maximum full power output from the heater will result. The temperature of the heating element(s) will remain almost constant because the gate signal goes on and off at a relatively high frequency compared to the response time of the heating element(s). This results in a steady output of heat from the heating elements with no significant expansion and contraction of the heating elements or the heater enclosure.

Figure 3:
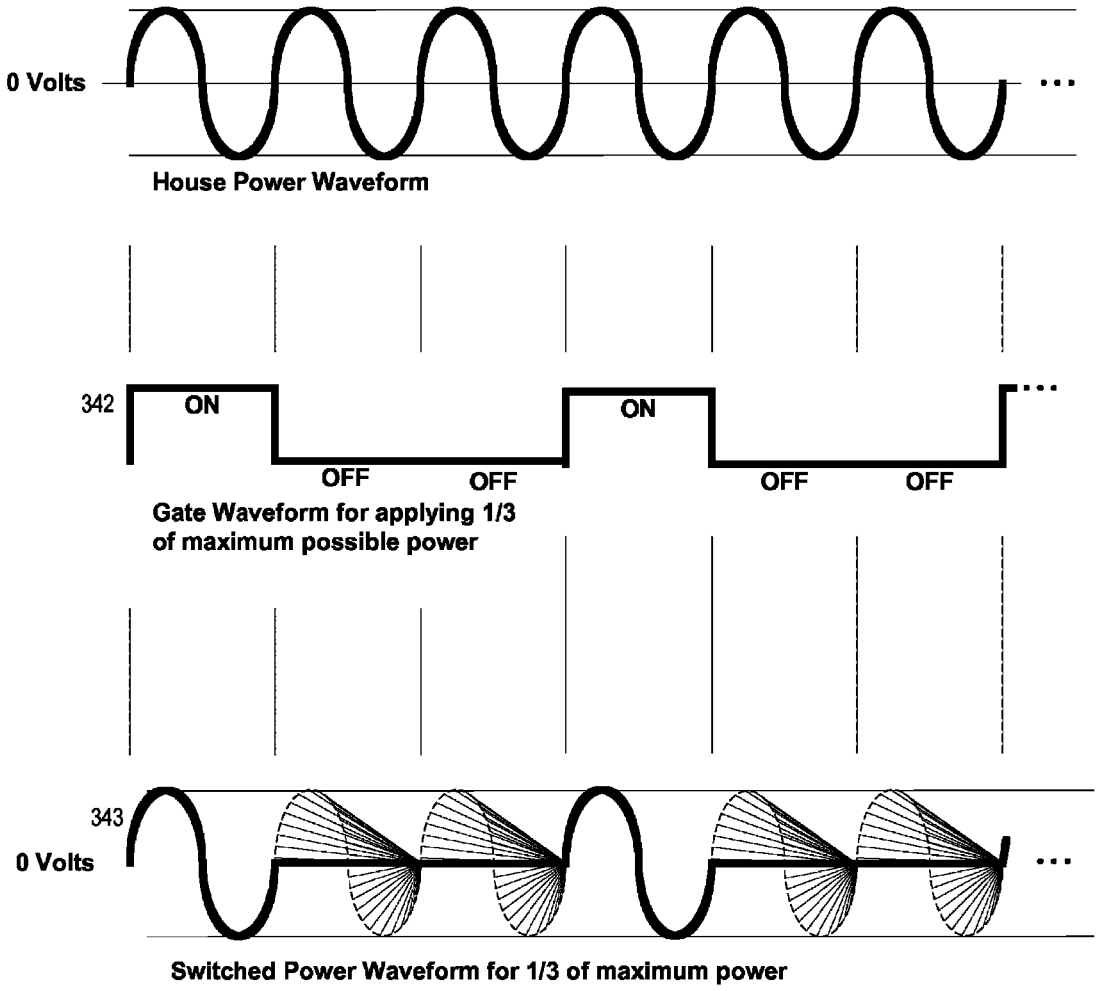
FIG. 3 shows waveforms for house power gated by a triac circuit applied to an electric heater such as to achieve production of approximately 33.3 percent (one-third) of maximum possible heat.

FIG. 3 is similar to FIG. 2 except instead of applying one-half of maximum power as described for FIG. 2, the exemplary gating waveform 342 shown in FIG. 3 produces a switched power waveform 343 with only one-third of the cycles ON and two-thirds OFF which thus applies one-third or 33.3% of maximum power to the heating element(s) of the electric heater resulting in one-third of the maximum possible heat.

Figure 4:
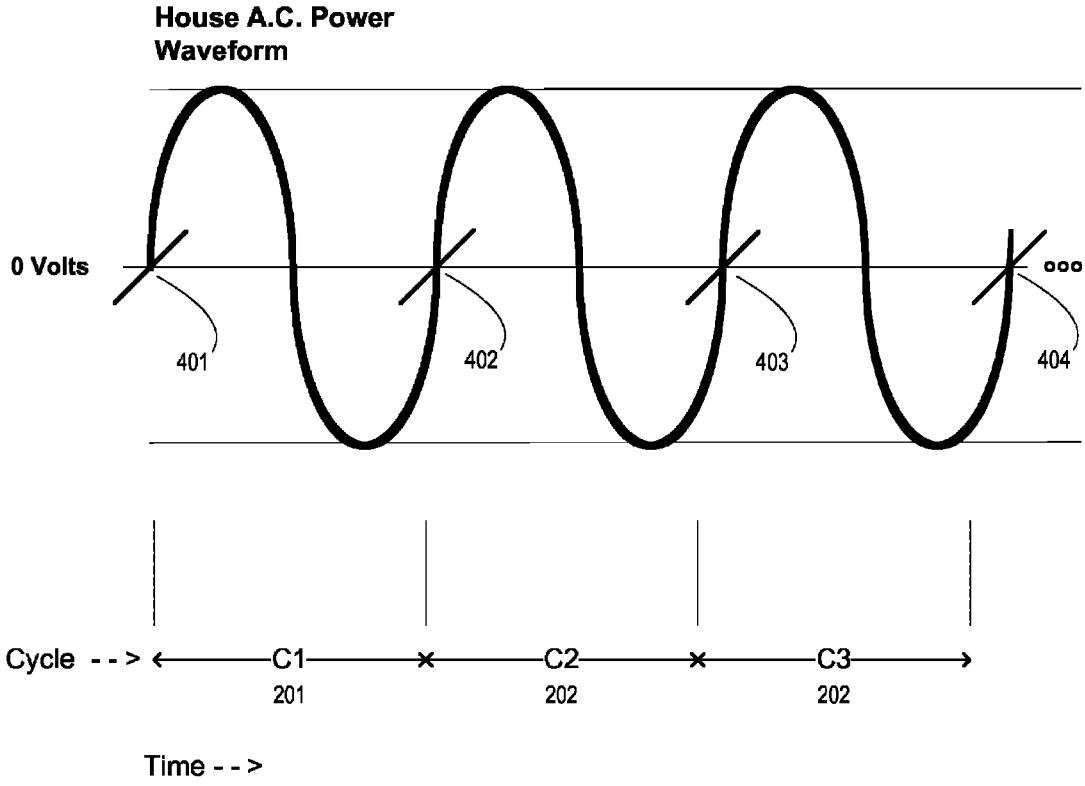
FIG. 4 shows a waveform exemplary of house power with zero crossing points marked for illustration purposes.

FIG. 4 shows a waveform exemplary of house power with zero crossing points marked for illustration purposes with diagonal tic marks 401 402 403 and 404 crossing the waveform. As in the other figures of the drawing cycles C1, C2 and C3 201 202 and 203 respectively refer to the first three cycles of the house a.c. power waveform. The first zero crossing point 401 is near the beginning of cycle C1, the second 402 is at the end of C1 and the beginning of C2 and continuing in the same manner for cycle C3 and beyond. The zero crossing points are important points to be recognized by the processing circuitry of the thermostat and utilized to determine the precise time for turning the gate waveform to the triac circuitry ON or OFF. The gating signal from the thermostat should be aligned such that the switch of the triac from ON to OFF or OFF to ON is achieved as close as possible to the time at which there is zero voltage and as a result zero current passing through the triac device. The thermostat would, in the preferred embodiment, use the power leads from a transformer supplying power to the thermostat from the house power to observe the house power waveform and anticipate the zero crossing.

These techniques of switching at the zero crossing are well known in the state of the art with the purpose of switching at the zero crossing point being to eliminate both heat dissipation inside the triac device and also to minimize radiated electro-magnetic noise. It is further noted in the preferred embodiment that the gating of the house a.c. power be such that only full cycles of power are switched off by the triac device. More specifically the control should maintain an equal number of positive and negative going halves of the power waveform in order to eliminate any direct current d.c. components from the wires carrying the power. In another embodiment of the present invention the zero crossing detection and gate control circuitry may be a part of the triac switching circuitry. The actual circuitry for control of the gate signal including determining the detection of the precise zero-crossing point and the timing of the gate switching into the triac or similar device may be incorporated as part of either the triac circuitry or in the thermostat or in circuitry separate from these circuits. The detailed design of the circuitry or method for achieving switching by the triac circuitry near or at the zero-crossing point is a detail of design that can be determined by someone knowledgeable in the state of the art.

FIG. 5 is a table of exemplary patterns for the gate input to a power gating triac type device which illustrate an aspect of the preferred embodiment and would result in application of several illustrative levels of average power to the heating elements of the electric heater. In FIG. 5, column one 501 of the table gives the desired percentage of power. The second column 502 contains an illustrative pattern for the gate input to the triac device that, when repeated indefinitely, would result in the desired level of power. The third and fourth columns 503 and 504 are the number of ON and OFF cycles respectively of the pattern in the second column 502. The fifth column 505 shows the ratio of cycles ON divided by the total number of ON plus OFF cycles, which ratio being the fraction of maximum possible cycles, which is the same as the ratio of power to maximum power at the output of the triac device. In the first row of the table 551, a power percentage of 50% of maximum is determined by the processing circuitry of the thermostat. An exemplary pattern of one cycle OFF and one cycle ON, repeated indefinitely, results in a ratio of ½ the maximum power passing through the triac device, that is, the number shown in row 1 column 5 of table 551. It is noted that one cycle OFF and one cycle ON is the shortest repeatable pattern that would provide ½ power, and therefore is the highest frequency pattern that could be applied for this level of power. Other longer patterns may also be used which provide the same level of power, that is 50 percent. The second row 552 illustrates a pattern of two cycles OFF followed by two cycles ON which achieves 50 percent power, with this pattern being of length four cycles. A third exemplary pattern providing 50 percent power is provided in the third row 553 of the table which is six cycles long, three cycles OFF followed by three cycles ON, and repeated. The precise pattern chosen during design or programming of the processing circuitry of the thermostat would be the choice of the designer and may be dependent on other parameters. For purposes of minimizing expansion and contraction and minimizing temperature gradients in the heating elements, the shortest possible pattern as shown in the first row would typically be chosen. The fourth and fifth rows 554 and 555 respectively of the table in FIG. 5 further illustrate patterns for 33.3 percent and 66.6 percent power, that is, applying ⅓ or ⅔ of maximum power.

FIG. 6 further illustrates more complex exemplary patterns for the gate input to a power gating triac type device for producing selected levels of average power. As in FIG. 5 the columns are labeled for percent power applied 601, the triac gate pattern 602, the number of gate ON cycles 602, the number of gate OFF cycles 604, and the ratio of gate ON divided by total cycles 605. In this FIG. 6 a constant length pattern twenty (20) cycles in length is illustrated as shown in the second column 602. Power levels from 0% up to 100% are shown in the twenty rows of the table with power levels incrementing by five percent as one goes down the table. It is noted that a period of one cycle would be 1/60 of a second with 60 Hertz power as typical in the United States, and 1/50 of a second in countries with 50 Hertz power.

It is further noted that within the twenty cycles of each pattern the ones and zeroes indicating ON and OFF cycles are spread relatively evenly across the twenty cycle pattern. This is not a requirement for achieving relatively small gradients of temperature in the coils of the electric heater elements with a period of 20 cycles, which is one-third of a second at 60 Hertz, but the more even the distribution of ON and OFF periods, the smaller the gradients of temperature will result.

As a further embodiment of the present invention, a heater which is controlled by an apparatus of the present invention as described in the prior paragraphs to reduce temperature gradients in the heating elements, the heater itself can be designed in anticipation of experiencing smaller temperature gradients. This would allow the heater to possibly be built of lighter weight materials, simpler design, lower cost of manufacture, or other such advantages in comparison with competing products.

It will be appreciated that the present invention is not in any limited by the packaging of the devices. In addition, circuitry of the thermostat, the triac device, the thermostat processing circuitry or other elements disclosed in connection with describing the invention may be changed without affecting the novel aspects of the invention. For example, the thermostat can be a simple temperature sensing device with the processing circuitry of the thermostat contained either within the thermostat or external to the thermostat. The triac may be contained in a package with processing circuitry of its own or in conjunction with the processing circuitry of the thermostat, or all elements of the invention could be combined and packaged as a unit.

Thus, while the principles of the invention have now been made clear in an illustrative embodiment, there will be immediately obvious to those skilled in the art many modifications of structure, arrangements, the elements, circuitry, materials, and components, used in the practice of the invention which are particularly adapted for specific environments and operating requirements without departing from those principles.

What is claimed is:

1. Apparatus for controlling an electric heater having a heating elements capable of producing heat for heating a room when connected to a house a.c. power source, the apparatus comprising:

a) a thermostat system including a temperature sensing device which produces a signal related to air temperature in the room, b) said thermostat system including temperature comparison circuitry providing a comparison of the air temperature in the room indicated by the temperature sensing device signal with a user set point temperature, c) processing circuitry operatively coupled to said thermostat producing an output corresponding to a power gating signal, d) a semiconductor power gating device for gating power from the house a.c. power source to the heating elements, the gating device receiving said power gating signal and conditionally gating the house a.c. power to the heating elements, e) said processing circuitry determining a percentage or fraction of maximum power from the house a.c. power source to be applied to the heating elements by controlling the application of the gating signal to the power gating device, the percentage or fraction of maximum power slowly being varied based upon the comparison of the temperature of the room with the set point temperature, f) said processing circuit changing the output gating signal to the power gating device at intervals of time less than a normal hysteresis time interval of the temperature comparison circuitry.

2. The apparatus of claim 1, wherein the output gating signal to the power gating device is changed at intervals less than five seconds.

3. The apparatus of claim 1, wherein the output gating signal to the power gating device is changed at intervals less than two seconds.

4. The apparatus of claim 1, wherein the output gating signal is changed at intervals based upon a count of the number of cycles of the house a.c. power.

5. The apparatus of claim 1, wherein the output gating signal is changed by the processing circuitry at intervals based upon a count of the number of cycles of the house a.c. power and the time for switching the gating signal from off to or or on to off is controlled such that the house a.c. power is effectively gated at or near the zero crossing for the voltage of the house a.c. power, and the gating signal being controlled such that on the average, full cycles of a.c. power are applied to the heating element of the electric heater.

6. The apparatus of claim 1, wherein the output gating signal can be changed by the processing circuitry at intervals of any desired number of cycles of house a.c. power with the processing circuitry proportioning the count of gated on and off signals such as to apply a sufficient amount of power as needed to produce a desired amount of heat for attaining the set point temperature.

7. The apparatus of claim 1, wherein the output gating signal can be changed by the processing circuitry at intervals having any desired number of cycles of house a.c. power, processing circuitry proportioning the count of gated on and off signals such as to slowly adjust the percentage or fraction of maximum power as needed to produce a needed amount of heat, and the output gating signal being changeable to operate within an interval that is less than two seconds.

8. The apparatus of claim 1, wherein the output gating signal is changed by the processing circuitry at intervals based upon a count of a number of cycles of house a.c. power, the processing circuitry proportioning the count of gated on and off signals such as to slowly adjust the percentage or fraction of maximum power as needed, controlling the timing of switching the gating signal from off to on or on to off such that the house a.c. power is effectively gated at or near the zero crossing of the voltage of the house a.c. power, and the gating signal being further controlled such that on the average either full cycles, or an approximately equal number of positive and negative half cycles of a.c. power are applied to the heating element of the electric heater.

9. The apparatus of claim 8, wherein the output gating signal to the power gating device is changed as needed to meet the requirements for a desired percentage or fraction of maximum power at intervals of less than five seconds.

10. The apparatus of claim 8, wherein the output gating signal to the power gating device can be changed as needed to meet the requirements for a desired percentage or fraction of maximum power at intervals of less than two seconds.

11. A method for controlling application of power from a house alternating current power supply to an electric heater system for heating a room, the method comprising the steps of:

A) providing a thermostat system which includes a temperature sensing device for comparing temperature in the room with a set point temperature;

B) providing processing circuitry operatively coupled to or as a part of the thermostat system;

C) determining a desired percentage or fraction of maximum possible heat from the electric heater system and slowly varying that desired percentage based upon the comparison of the temperature of the heated space with the set point temperature;

D) providing a power gating device capable of switching or controlling application of power from a house alternating current power supply to the electric heater;

E) generating by the processing circuitry a gating signal which controls the power gating device and turns the power on and off to the heating element of the electric heater, the gating signal having a minimum switching time that is less than fifteen seconds and a ratio of power on time to total time being made approximately equal to the desired percentage or fraction of maximum possible heat from the electric heater system.

12. The method of claim 11 wherein in step E) the minimum switching time for the gating signal is further limited to be less than five seconds in duration.

13. The method of claim 11 wherein in step E) the minimum switching time for the gating signal is further limited to be less than two seconds in duration.

14. The method of claim 11 wherein in step E) the timing of the gating signal is based upon a count of the number of alternating current cycles of the house alternating current power supply.

* * * * *